US009994290B2

(12) United States Patent
Cabrinha et al.

(10) Patent No.: US 9,994,290 B2
(45) Date of Patent: Jun. 12, 2018

(54) COUPLING DEVICE FOR A SPORTS HARNESS AND SPORTS HARNESS

(71) Applicant: Neil Pryde Limited, New Territories, Hong Kong (CN)

(72) Inventors: Pete Cabrinha, Hong Kong (CN); David Starbuck, Hong Kong (CN); Philip Sobolev, Hong Kong (CN); David Hastilow, Hong Kong (CN)

( * ) Notice: Subject to any disclaimer, the term of this patent is extended or adjusted under 35 U.S.C. 154(b) by 56 days.

(21) Appl. No.: 14/957,927

(22) Filed: Dec. 3, 2015

(65) Prior Publication Data

US 2016/0159443 A1 Jun. 9, 2016

Related U.S. Application Data

(63) Continuation-in-part of application No. 14/559,179, filed on Dec. 3, 2014.

(51) Int. Cl.
*B63B 35/79* (2006.01)
*B63H 9/10* (2006.01)

(52) U.S. Cl.
CPC ..... *B63B 35/7976* (2013.01); *B63B 35/7979* (2013.01); *B63B 35/7993* (2013.01); *B63H 9/1007* (2013.01)

(58) Field of Classification Search
CPC ..... B63B 35/7993; B63B 35/7979; B63B 35/7996; B63H 9/1007; B63H 9/1014
See application file for complete search history.

(56) References Cited

U.S. PATENT DOCUMENTS 2,273,209 A * 2/1942 Louthan ..... A01K 91/08 43/43.13
4,452,161 A * 6/1984 McCoy ..... B63B 35/7993 114/39.18
4,934,297 A * 6/1990 Long ..... B63B 35/7993 114/39.16
D321,234 S * 10/1991 Fildan ..... D21/771
5,150,901 A * 9/1992 Stawicki ..... A63B 69/365 473/215
6,293,215 B1 * 9/2001 Moorrees ..... B63B 35/7993 114/39.18
6,508,186 B2 * 1/2003 Veh ..... A44B 11/125 114/39.18

(Continued)

FOREIGN PATENT DOCUMENTS

DE 10302015 A1 * 8/2004 ..... B63B 35/7993
DE 102014113969 * 2/2016 ..... B63H 9/1007

(Continued)

OTHER PUBLICATIONS http://www.yachtsandyachting.com/news/179787/Allen-Keyball-Trapeze-System Allen Brothers, Oct. 27, 2014 webpage.*

*Primary Examiner* — Benjamin P Lee
(74) *Attorney, Agent, or Firm* — Leydig Voit and Mayer

(57) ABSTRACT

A hookless coupling device for a sports harness has an elongate body having a connector end for connection with a sports harness and an engagement end. An elongate aperture extends between the connector end and the engagement end. The aperture is wider at the connector end, for receiving an engager through the aperture, than at the engagement end provided for engaging the engager with the elongate body.

16 Claims, 16 Drawing Sheets

(56) References Cited

U.S. PATENT DOCUMENTS

| | | | | |
|---|---|---|---|---|
| 7,992,506 | B1 * | 8/2011 | Patton | B63B 35/7979 114/39.18 |
| 2004/0065780 | A1 * | 4/2004 | Bellacera | B63B 35/7979 244/155 A |
| 2006/0046589 | A1 * | 3/2006 | Farley | B63B 35/79 441/108 |
| 2009/0159752 | A1 * | 6/2009 | Maldonado | B63B 35/7979 244/155 A |
| 2016/0159443 | A1 * | 6/2016 | Cabrinha | B63B 35/7976 114/39.18 |
| 2016/0221649 | A1 * | 8/2016 | Harrington | B63B 35/7993 |

FOREIGN PATENT DOCUMENTS

| | | | | |
|---|---|---|---|---|
| WO | WO 2012056060 | A1 * | 5/2012 | B62B 1/12 |
| WO | WO 2013111169 | A1 * | 8/2013 | B63B 35/7993 |
| WO | WO 2015031977 | A1 * | 3/2015 | B63B 35/7993 |

* cited by examiner

COUPLING DEVICE FOR A SPORTS HARNESS AND SPORTS HARNESS

FIELD OF THE INVENTION

The present invention relates to a coupling device for a sports harness. The invention also relates to a sports harness with engagement and engager means for releasably coupling a sports device to the harness.

BACKGROUND TO THE INVENTION

In wind driven sports such as kiteboarding, windsurfing and sailing a sportsperson wears a harness to which the sports device can be releasably coupled. The harness includes a spreader bar with a downwardly orientated hook. The sports device also includes a loop on a tether, or line, which can be engaged with the hook to releasably couple the sports device to the harness. The pull of the sports device on the hook and harness is generally in an upwards direction and outwards, for example in kiteboarding the kite is often maneuvered overhead of the rider. The hook must have a downward orientation in order to retain the loop. However, the upwards pull of the sports device can cause rotation of the spreader bar and front of the harness causing discomfort to the sportsperson.

Wind driven sports utilising a harness coupling arrangement are most frequently performed on water and involve a sports device having a number of lines. An additional disadvantage of the tradition hook and hoop coupling arrangement is the risk of lines unintentionally catching or tangling with the hook and posing a danger to the sportsperson.

It is an object of the present invention to overcome or at least ameliorate these disadvantages with traditional hook and loop coupling of wind drive sports devices.

SUMMARY OF THE INVENTION

One or move aspects of the present invention are set forth in the accompanying claims.

In a first particular aspect of the invention there is provided a hookless coupling device for a sports harness, the coupling device comprising an elongate body having a connector end for connection with a sports harness and an engagement end, and an elongate aperture extending between the connector end and the engagement end, the aperture wider at the connector end for receiving an engager through the aperture and narrower at the engagement end for engaging the engager with the elongate body.

In a second particular aspect of the invention there is provided a band for surrounding a waist or hips of a person, a hookless elongate body extending upwardly and away from the band, and an elongate aperture in the body, the aperture having a harness end and an engagement end, the aperture wider at the harness end for receiving an engager through the aperture and narrower at the engagement end for engaging the engager with the elongate body.

In a third particular aspect of the invention there is provided a sports kite comprising a canopy, a traction line having a first end tethered with the canopy and a second end, a spherical engager connected to the second end of the traction line, and a hookless engagement body connectable with a harness, the hookless engagement body including an elongate aperture, the aperture having a harness end and an engagement end, the aperture wider at the harness end for receiving the engager through the aperture and narrower at the engagement end for engaging the engager.

Further inventions or aspects of the invention may become apparent from the following description which is given by way of example only.

BRIEF DESCRIPTION OF THE DRAWINGS

The invention will now be described with reference to the accompanying drawings in which.

DESCRIPTION OF THE PREFERRED EMBODIMENTS

The following description is given by way of example only to illustrate the invention and is not intended to limit the scope of use or functionality of the invention. In particular, the invention is not limited in its application to the details of construction and the arrangements of components set forth in the following description or illustrated in the accompanying drawings. The invention is capable of other embodiments and of being practiced or being carried out in various ways. Also, it is to be understood that the phraseology and terminology used is for the purpose of description and should not be regarded as limiting, unless otherwise expressly stated.

In the description and claims the term "hookless" means not having or utilising a hook as one element in a coupling means (i.e., a hook and loop as is currently known in wind driven sports such as kiteboarding, windsurfing and sailing). The terms "distal", "proximal", "inwardly", "towards", "upwardly", "away from", "outwardly", "up", "down", forward" and "lower most" are to be interpreted with reference to the in-use, in-situ or operational placement of a device, body or object in relation to a sportsperson using said device or body or object in a normal standing or operating posture.

Figure 1:
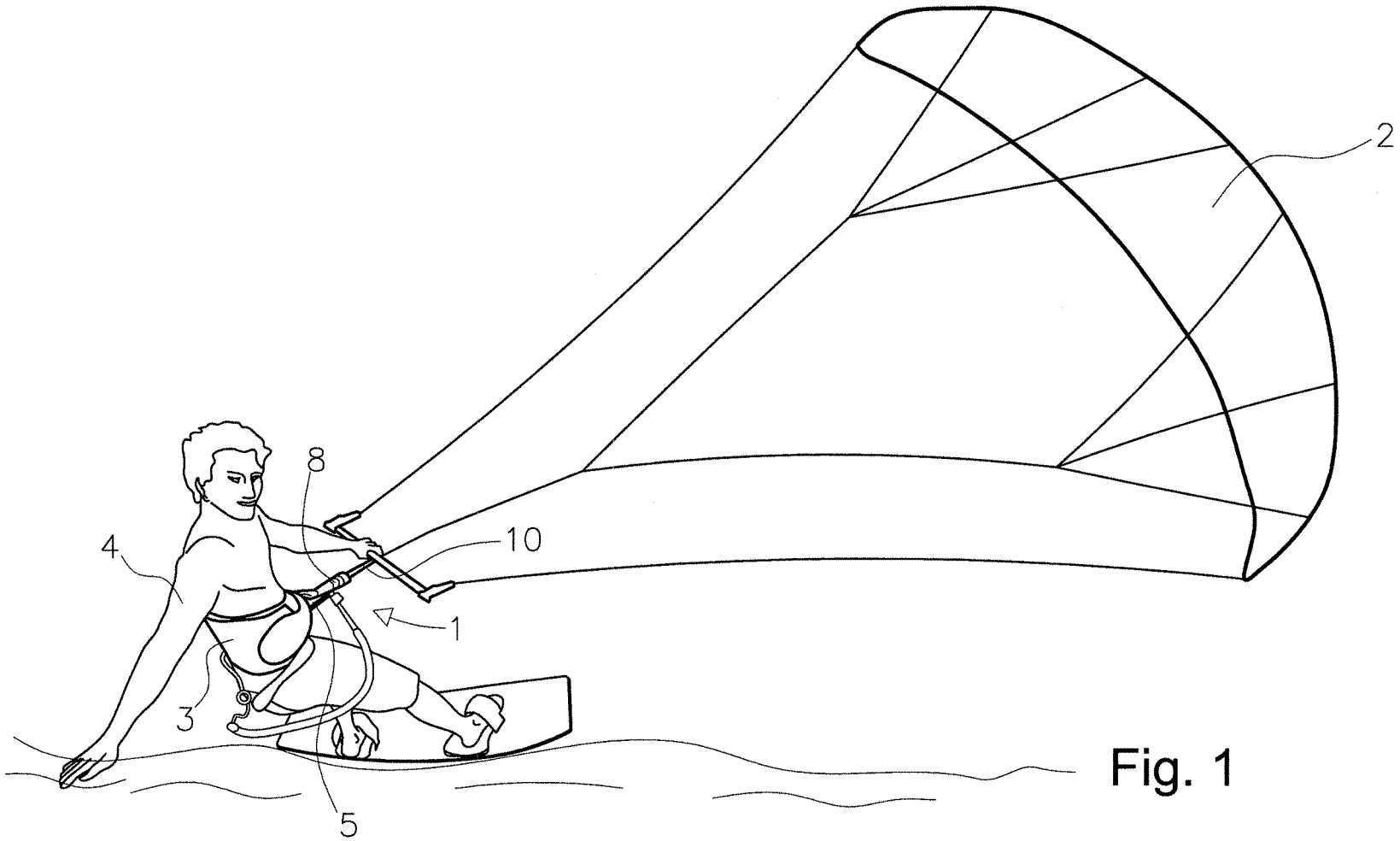
FIG. 1 illustrates a sports kite and rider set-up.

FIG. 1 illustrates a general kite surfing set-up in which a rider or kite surfer 4 riding a waters sports board utilises a large transition kite 2 to pull the rider and board across the surface of a body of water. The rider wears a harness 3 to which a traction line 10 of the kite can be releasably coupled. The invention provides a hookless coupling device for releasably securing the kite 2 to the rider's harness 3.

In its broadest embodiment the hookless coupling device is an elongate body or structure 5 that can be connected at a proximal end 6 to a sports harness 3 and has an opposite distal engagement end 7 to which the sports device 2 releasable couples by way of an engager 8 connected to the sports device traction line 10. The body 5 has an elongate aperture 9, 11 that preferably extends substantially the length of the body 5 between the proximal harness connector end 6 and the distal engagement end 7. The aperture 9, 11 is wider in breadth at the harness connector end 6, i.e. the wider end 11, to allow the engager 8 to pass through the aperture 9, 11. The aperture 9 narrows towards the engagement end 7 such that the engager 8 cannot pass through the aperture 9 at the engagement end 7. In use the elongate body 5 extends upwardly and away from the harness 3 and sportsperson 4 wearing the harness 3. The engager 8, which is tethered to the sports device 2 by the traction line 10 (or rope in non-nautical terms), is passed through the wider end 11 of the aperture 9, 11 (see for example movement indicated by arrows A and B in FIG. 2) and moved towards the engagement end 7 where it cannot pass back though the aperture 9 and therefore engages with the engagement end 7 of the body 5 to couple the tethered sports device 2 to the body 5 and the harness 3 (see for example the engaged/tethered position in FIG. 3). In the most preferred embodiment the engager 8 is a spherical shaped body, or ball, and the body 5 has a semi-circular or cup-shaped socket 12 at the engagement end 7 communicating with the aperture 9 so that when a spherical engager 8 is moved to the engagement end 7 it is received within the socket 12 to pivotally engage the body 5 and engager 8 in the manner of a ball and socket joint.

Figure 2:
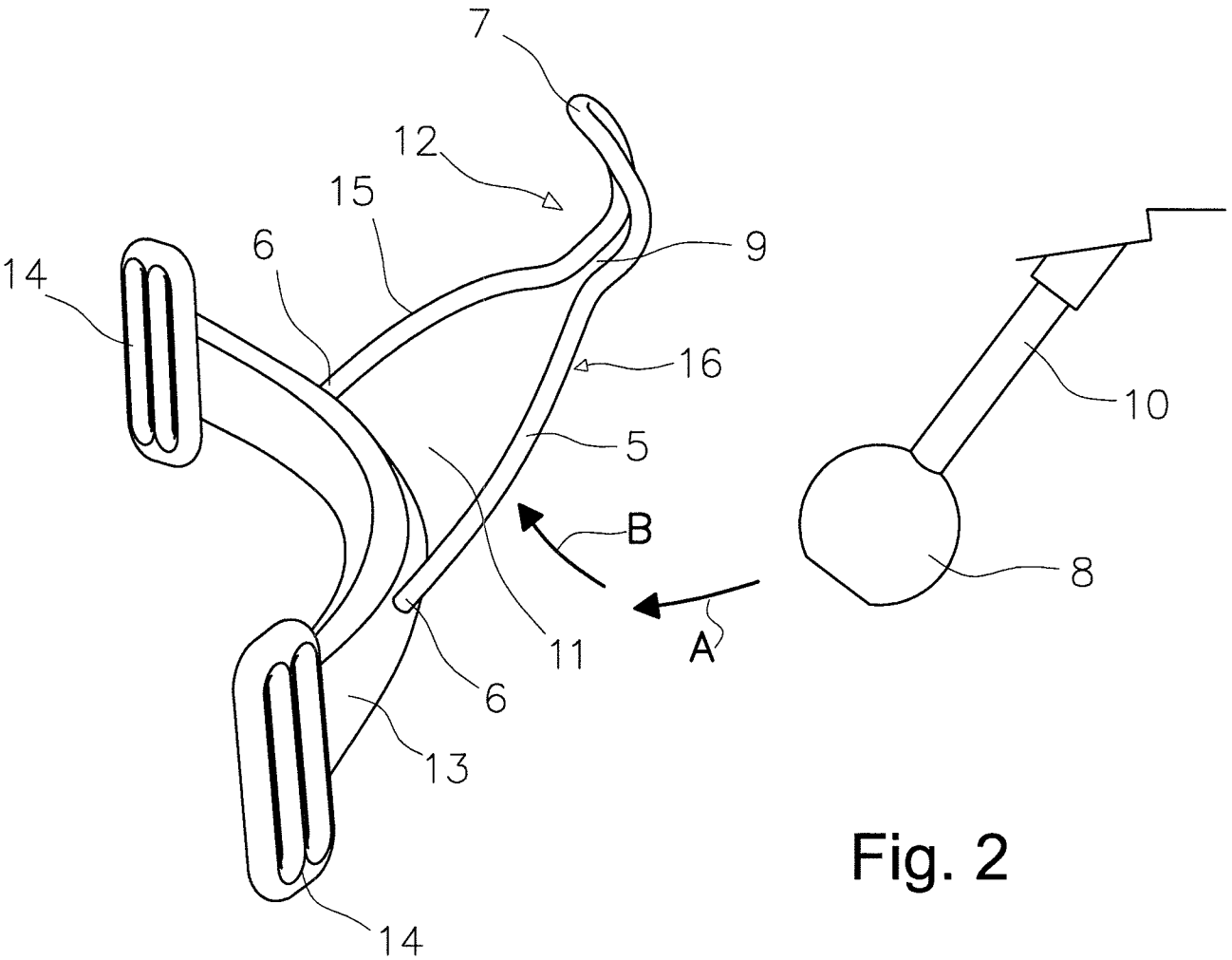
FIG. 2 illustrates a hookless spreader bar and coupling according to the invention.
Figure 4:
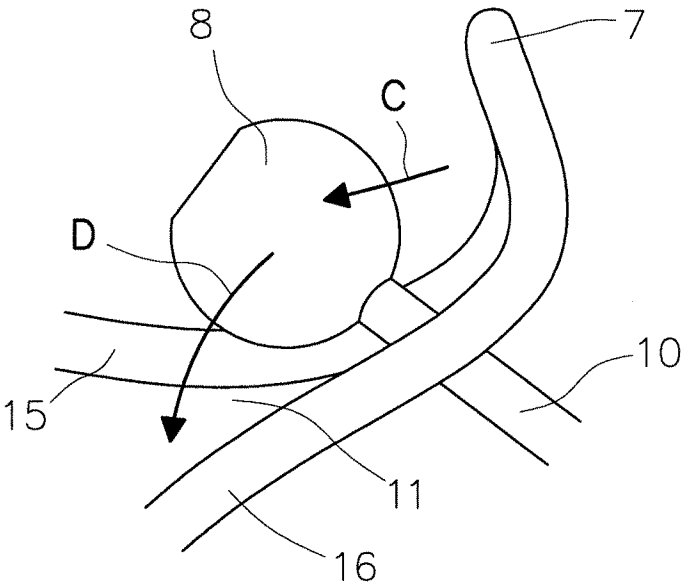
FIG. 4 illustrates the ball and socket of the hookless coupling.
Figure 3:
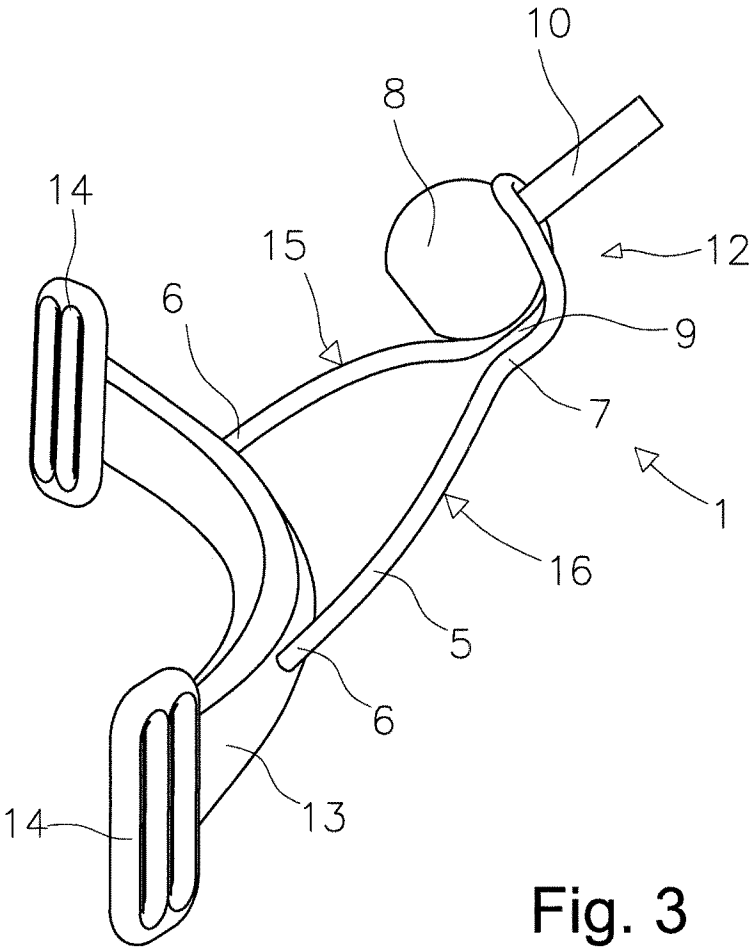
FIG. 3 illustrates the hookless spreader bar and coupling in a coupled arrangement.

FIGS. 2 and 3 illustrate how the engager 8 and hookless coupling device 5 are coupled and uncoupled. To couple the kite 2 the rider 3 moves the engager 8 tethered to the kite line 10 from a low position in an inwardly direction, as indicated by arrow A, and then upwardly in the direction, as indicated by arrow B, so that the engager 8 passes through the wider end 11 of the hookless coupling device slot. The engager once through wider end 11 of the slot is moved upwardly and away from the rider to secure it with the engagement end 7 of the hookless coupling device. Generally in normal use the pull direction of the tethered sports device 2 is upwardly and away from the sportsperson 3 operating the sports device 2. The pull of the sports device 2 is thus from the wider harness connector end 6 towards the engagement end 7 and assists in moving and holding the engager 8 into the engaged position at the engagement end 7 of the body 5. In order to uncouple the tethered sports device 2 from the riders harness the rider must move the engager 8 in the opposite direction of the pull, which is inwardly towards the riders body, as indicated by arrow C, and then downwardly, as indicated by arrow D, though the wider end 11 of the aperture 9. To facilitate movement of the engager 8 as required the proximal end of the traction line 10, immediately adjacent the engager 8, is provided with an outer sleeve of flexible vinyl tubing, such as flexible Polyvinylchloride (PVC) tubing, or the like that is graspable by the rider for manipulating the position of the engager 8.

In one embodiment the elongate body 5 is connected with the sports harness 3 by way of a spreader bar 13. The spreader bar 13 is affixed at the connector end 6 of the elongate body 5. The spreader bar 13 is orthogonal to longitudinal direction of the elongate body 5 which is affixed at the centre of the bar 13. At either end of the spreader bar 13 there are buckles or other means 14 for attaching the spreader bar 13 with straps of a sports harness 3 in known manner. In other embodiments the elongate body 5 is connected with the sports harness 3 by means other than a spreader bar. For example, in one alternative embodiment the elongate body 5 may have a buckle at its connector end 6 for attachment directly to a strap of the sports harness 3. It is preferable, although not essential, that the elongate body 5 be held in a position upwardly and away from the harness 3 when not engaged with the engager 8 of the sports device 2 so that the engager 8 may be easily engaged with the aperture 9 of the elongate body 5 quickly and with one hand. The spreader bar 13 maintains the elongate body 5 in this ready orientation. In an alternative embodiment using for example a buckle and strap to attach the elongate body 5 to the harness 3, a pocket or strap/flap on the harness or plastic fitting can be used to maintain the elongate body in an upwardly and outwardly orientation.

Figure 16:
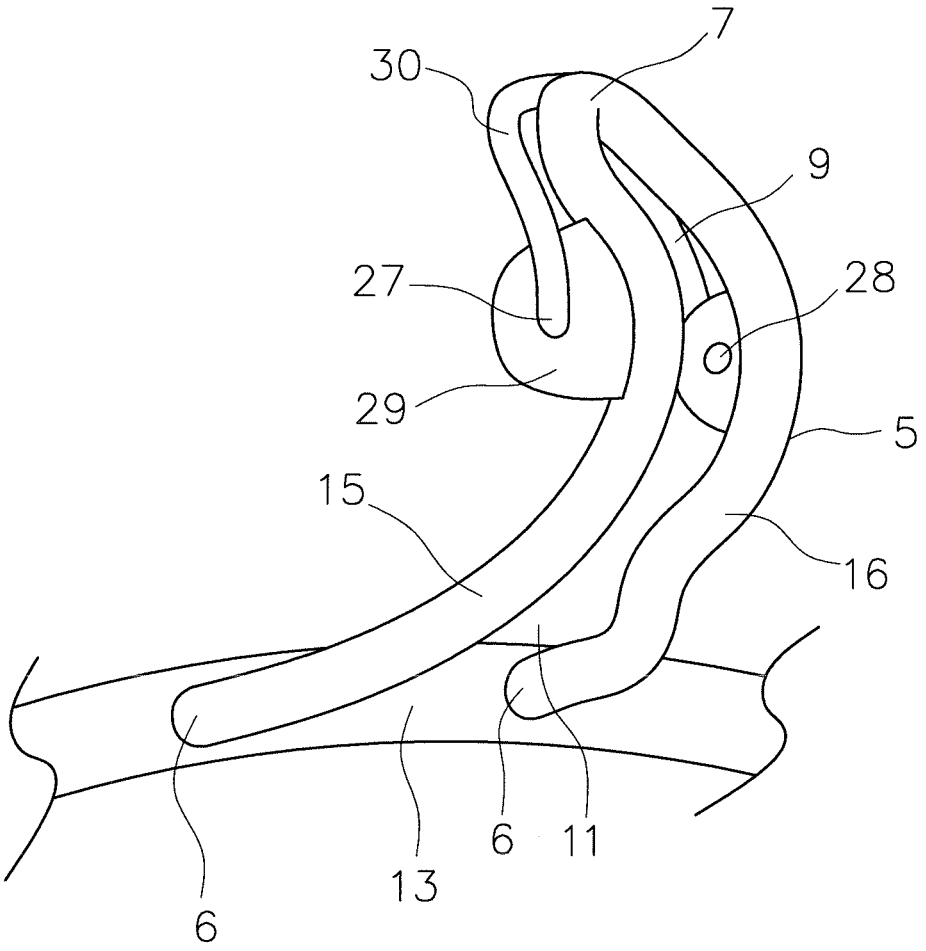
FIG. 16 illustrates the second hookless coupling socket and gate in an integrally fixed combination with a spreader bar.

In one embodiment, for example shown in FIGS. 2, 3 and 16, the elongate body 5 and aperture 9 are formed by a frame of stiff wire bent in an inverted U-shape being narrower at the blind end of the U to form the engagement end 7 of the body 5 with narrow portion of the aperture slot 9, and wider at the free tail ends 6 of the U to form the wider proximal end 11 of the aperture 9. The free tail ends 6 of two side legs 15, 16 of the U-shaped wire frame are affixed to the centre section of the spreader bar 13 by any one of various suitable means of welding for example. The two legs 15, 16 form two sides of the frame defining opposite elongate edges of the aperture 9. The top of the U forms a curved end 7 joining the sides at the engagement end of the elongate body 5. The two legs 15, 16 forming two sides of the frame 5 may not be parallel, but diverge towards the tail ends attached to the spreader bar to provide the wider slot 11 at the connector end 6 for the engager 8 to pass through. Alternatively, and perhaps preferably, the two legs 15, 16 forming two sides of the frame may have outwardly bent dog-legs to provide a wider slot 11 at the connector end 6 for the engager 8 to pass through. The curved end 7 of the U may also be bent upwardly in a progressive curvilinear profile about an axis transverse to the longitudinal direction of the elongate slot 9, 11 at the engagement end 7 to form the semi-circular socket 12 for pivotally receiving a ball shaped engager 8.

Figure 5:
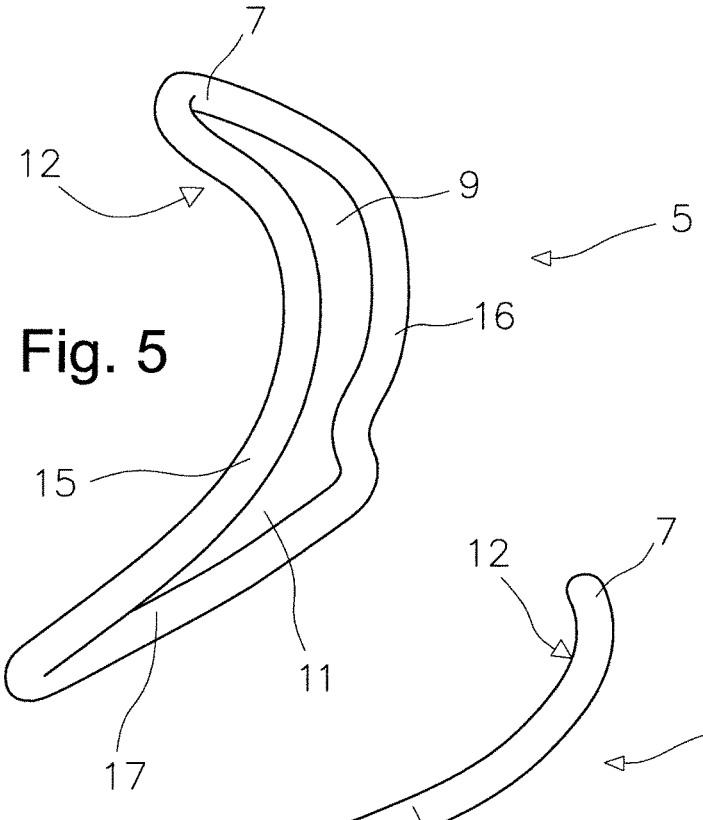
FIG. 5 is a perspective illustration of a hookless coupling socket according to the invention.
Figure 6:
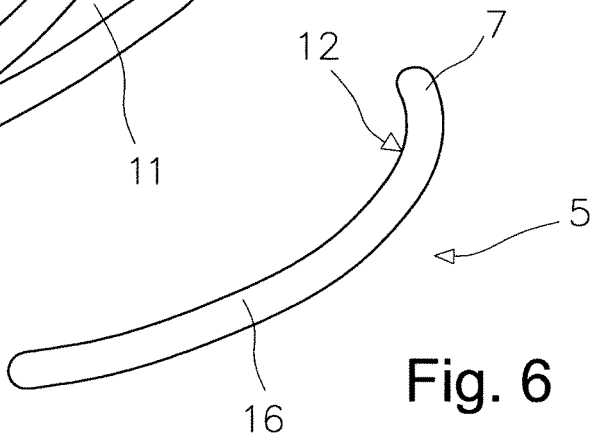
FIG. 6 is a side illustration of the hookless coupling socket of FIG. 5.
Figure 7:
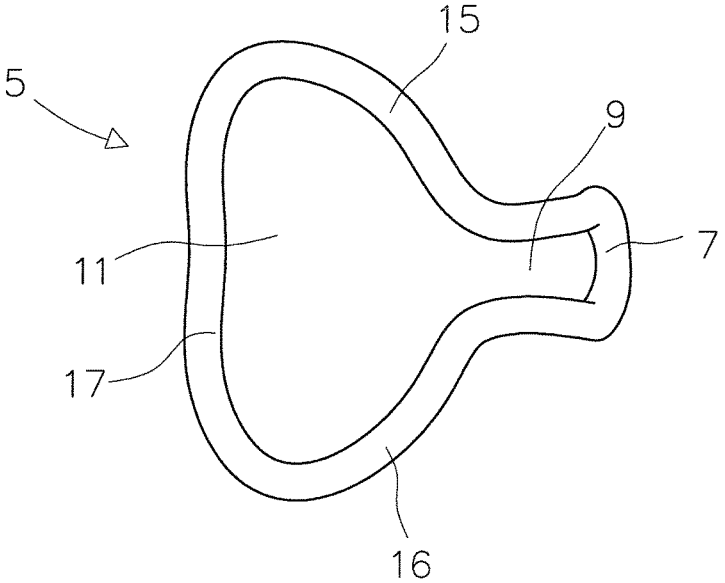
FIG. 7 is a bottom illustration of the hookless coupling socket of FIGS. 5 and 6.
Figure 8:
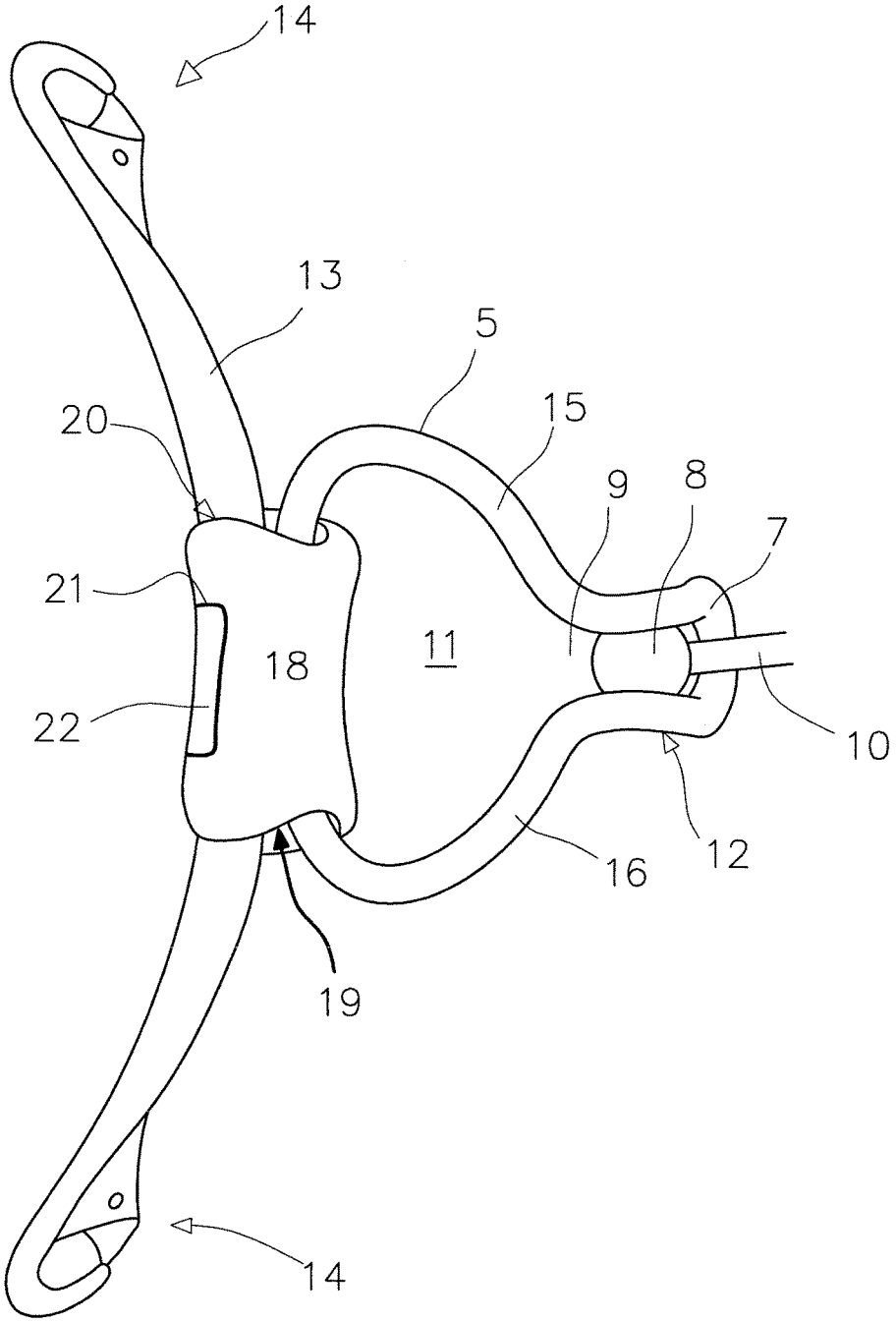
FIG. 8 illustrates the hookless coupling socket of FIGS. 5 through 7 in combination with a spreader bar.
Figure 9:
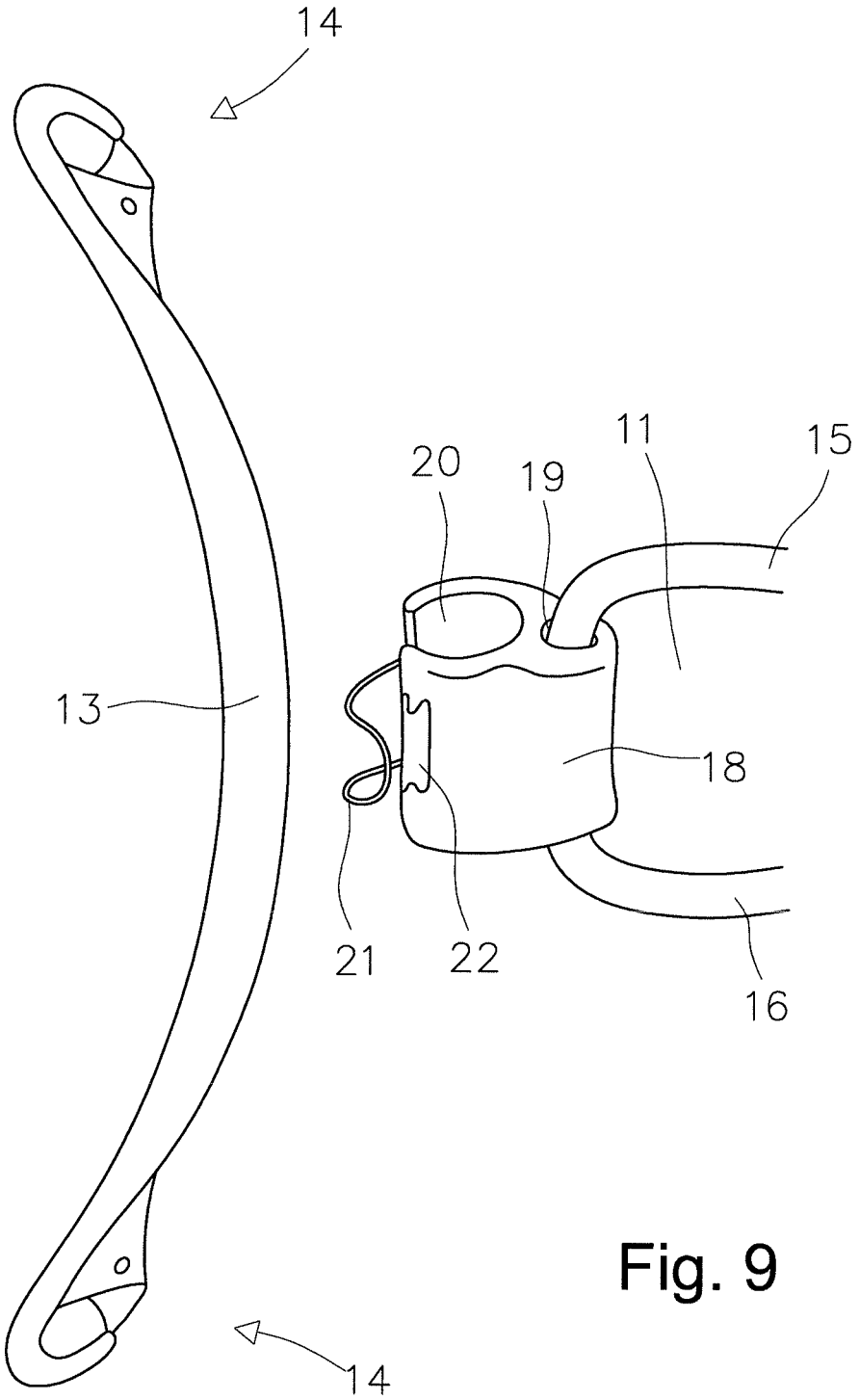
FIG. 9 illustrates a first connector for the hookless coupling socket and spreader bar of FIG. 8.
Figure 10:
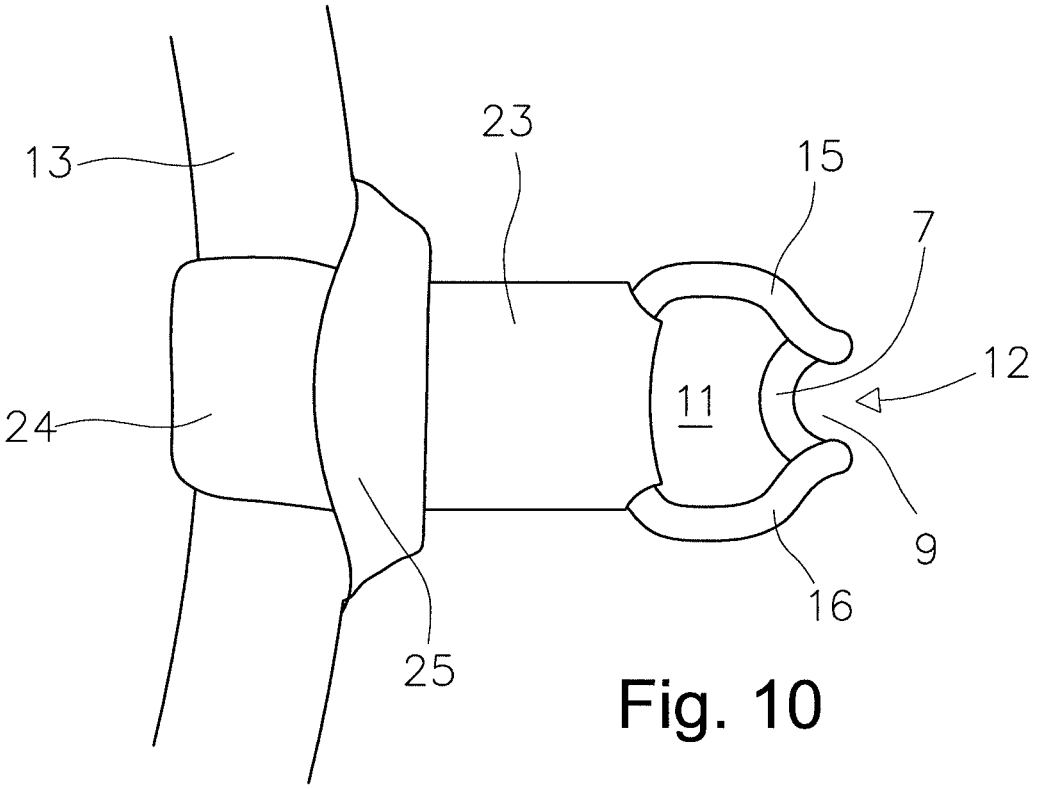
FIG. 10 is a bottom illustration of a second connector for a hookless coupling socket and spreader bar.
Figure 11:
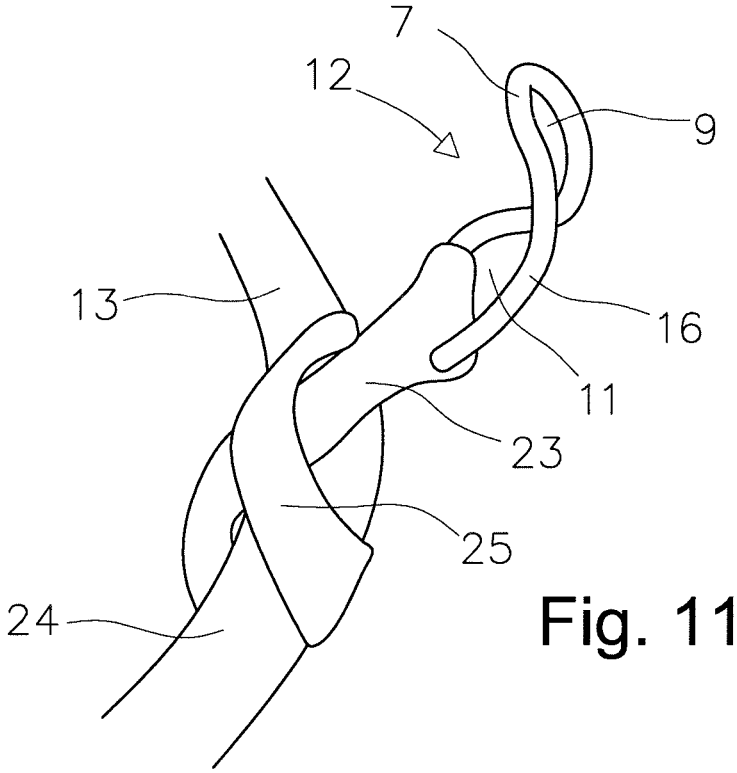
FIG. 11 is a perspective illustration of the second connector of FIG. 10.
Figure 12:
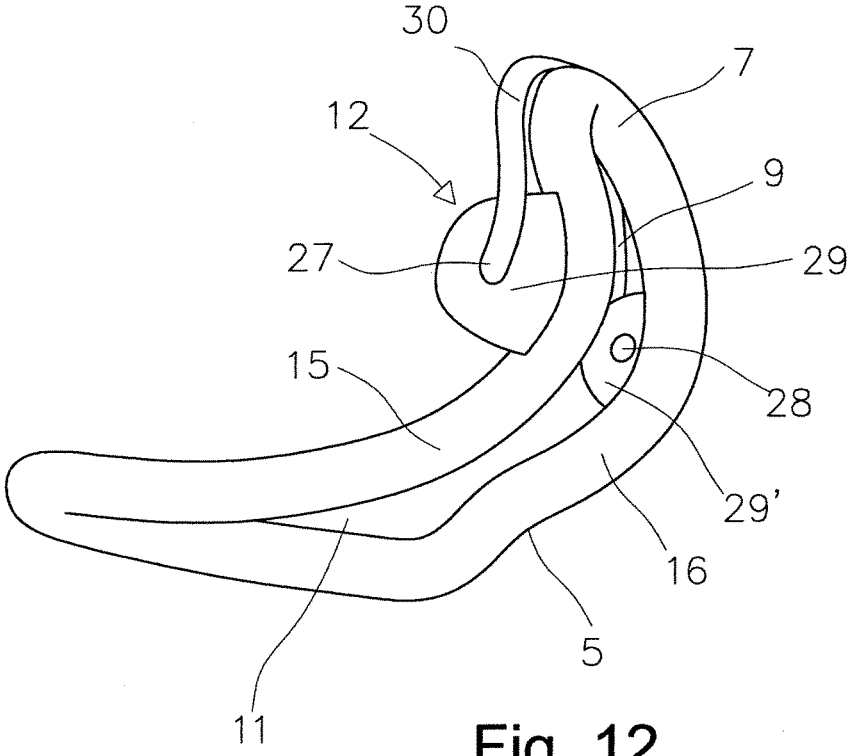
FIG. 12 is a perspective illustration of a second hookless coupling socket according to the invention, the second socket having a securing gate for the coupling ball.
Figure 13:
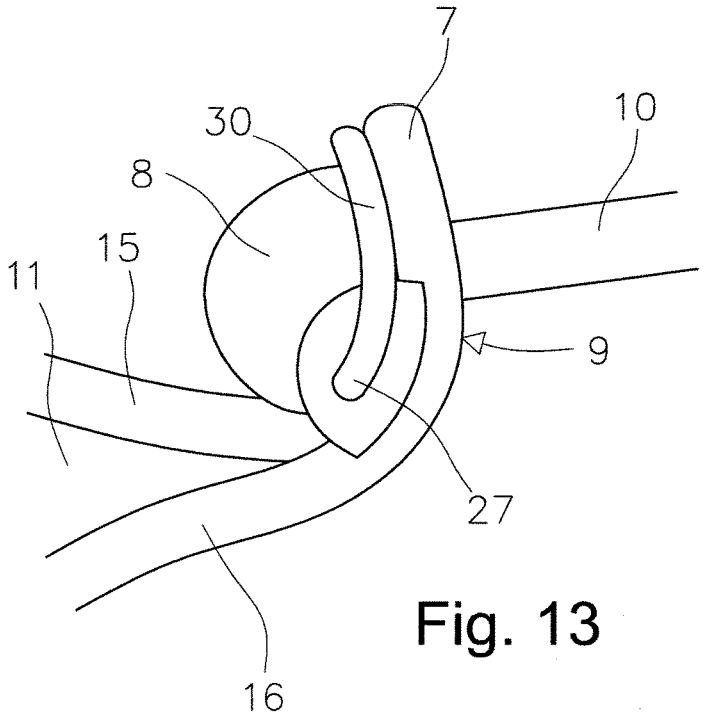
FIG. 13 illustrates the socket and gate of FIG. 12 with the gate in a non-securing position.
Figure 14:
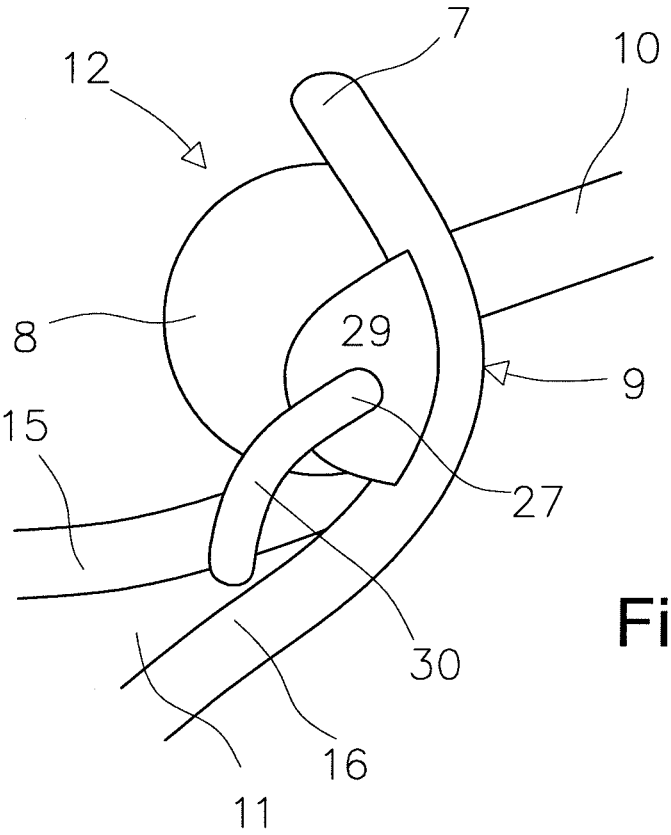
FIG. 14 illustrates the socket and gate of FIG. 12 with the gate in a securing position.
Figure 15:
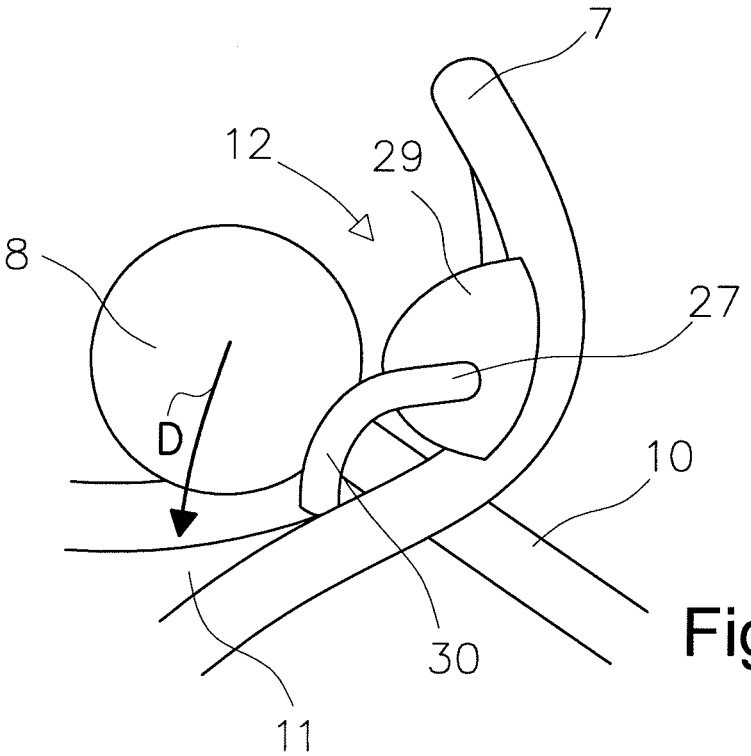
FIG. 15 illustrates how the ball is secured by the gate in the securing position.

FIGS. 5 through 7 show an alternative embodiment of the hookless coupling device 5 which may be connected directly to a sports harness 3 by a buckle or other means as aforementioned. In such an embodiment the device 5 has the same configuration as other embodiments from the engagement end 7 to the wider slot 11 at the connector end 6 for the engager 8 to pass through. In this embodiment the connector ends 6 of the body are closed by a transverse leg 17 that closes-the-loop, sans the spreader bar 13, on the elongate slot 9, 11. A strap and buckle or other such coupling means can engage with the transverse leg 17 to secure the hookless coupling device 5 directly to the harness without a spreader bar 13. Alternatively such a hookless coupling device 5 can also be removably connected with a spreader bar 13 in a flexible manner as illustrated in FIGS. 8 through 11. FIGS. 8 and 9 illustrate a plastic or elastic body 18 for connecting the closed-loop embodiment of the hookless coupling device 5 with the spreader bar 13. The connecting body 18 has a first aperture 19 mounded or otherwise formed about the proximal transverse leg 17 of the closed-loop hookless coupling device 5. A second C-shaped aperture 20 is provide parallel to the first aperture 19 and has an open edge to allow the centre region on the spreader bar 13 to be introduced into the second aperture 20. A securing cord or spring clip 21 is provided and engageable with a catch 22 for closing the open edge of the second aperture 20 about the received spreader bar 13 thereby flexibly and releasably connecting the hookless coupling device 5 to the spreader bar 13. As an alternative arrangement shown in FIGS. 10 and 11 a webbing strap is used to secure the hookless coupling device 5 to the spreader bar. A webbing loop is secured to or around the proximal transverse leg 17 of the hookless coupling device 5 at its first end 23. The middle 24 of the loop is passed abound the central region of the spreader bar 13 and hookless coupling device 5 passed through the distal end 25 of the webbing loop to secure the loop and hookless coupling device 5 to the spreader bar in a flexible and releasable manner In some situations, such as training for example, it is preferable to secure the ball engager 8 with the hookless coupling device 5 so that it cannot become uncoupled inadvertently. FIGS. 12 through 16 show an arrangement of the hookless coupling device 5 with a securing gate 30 that can be closed to secure the ball engager 8 with the hookless coupling device 5. In this embodiment a pair of tabs 29 are attached to respective side legs 15, 16 of the body 5 adjacent the narrower engagement end 7. A U-shaped gate 30 is pivotally secured to respective ones of the tabs 29 by its two open ends 27, 28. The shape of the U-shaped gate 30 and position of the tabs 29 is such that the gate 30 follows closely the engagement end 7 of the body, and when moved to the secured position as discussed below, the gate can pass about the ball engager 8 and interfere with the wider end 11 of the elongate slot 9, 11. In a first, non-securing position, as shown in FIG. 13, the gate is positioned to lie against the engagement end 7 of the body 5 and closely follow the curved shape of the engagement end 7. The ball engager 8 can be coupled with the hookless coupling device 5 as aforementioned. To secure the ball engager 8 in the engaged position with the hookless coupling device 5 the user manually flips, or pivots, the gate 30 to a second position, as shown in FIG. 14, such that the gate 30 passes around the ball engager 8 and interferes with the wider end 11 of the elongate slot 9, 11. FIG. 15 illustrates that with the gate 30 to a second securing position the ball engager 8 cannot be moved in the downwardly direction of arrow D through the wider end 11 of the slot as required to uncouple the ball engager 8 and hookless coupling device 5. The gate 30 interferes with the ball engager 8 and traction line 10 preventing the ball engager 8 from passing through the wider end 11 of the elongate slot 9, 11. To uncouple the ball engager 8 and hookless coupling device 5 the rider must flip, or pivot, the gate 30 back to a first position, as shown in FIG. 13.

FIGS. 17 through 20 show a yet further alternative embodiment of the hookless coupling device 5, which includes a second embodiment of a gate for prevention unintentional uncoupling of the ball engager 8 and hookless coupling device 5 is shown. In this embodiment instead of a hinged gate, a hemispherical-shaped cup or plug 31 is coupled to the hookless coupling device 5 by a resiliently elastic cord 36 which causes the hemispherical-shaped cup 31 to removably interfere with the wider end 11 of the elongate slot 9, 11 to prevent the ball engager 8 from passing through the wider end 11 of the elongate slot 9, 11. The hemispherical-shaped cup 31 comprises a hemispherical outer surface, a hollow interior cavity defining a hemispherical inner surface 32 and a circular equatorial edge 33 between the outer and inner surfaces 31, 32. The hemispherical-shaped cup 31 is coupled to the hookless coupling device 5 by a pair of resiliently elastic cords 36. The resiliently elastic cords 36 are coupled at their respective proximal ends to a coupler 37 on the spreader such that respective ones of the resiliently elastic cords 36 pass over the top edge of the two side legs 15, 16 of the hookless coupling device 5 and down through the elongate slot 9, 11. Alternatively, the resiliently elastic cords 36 are coupled adjacent to or with respective connector ends 6 of the hookless coupling device 5. The distal ends of the resiliently elastic cords 36 are coupled with the hemispherical-shaped cup 31 at a position adjacent or just below the circular equatorial edge 33 between the outer and inner surfaces 31, 32. The distal ends of the resiliently elastic cords 36 may be co joined in a continuous loop thought adjacent apertures in the hemispherical-shaped cup 31 as evident in FIG. 20. Diametrically opposite the resiliently elastic cords 36 is a short length of cord 34 attached at its proximal end to the hemispherical-shaped cup 31. The cord 34 is non-elastic and has a graspable ferrule 35 at its distal end. The cord 34 and a graspable ferrule 35 may be used to apply tension to the resiliently elastic cords 36, via the hemispherical-shaped cup 31, by "pulling" the graspable ferrule 35 downwardly and away from the hookless coupling device 5.

Figure 17:
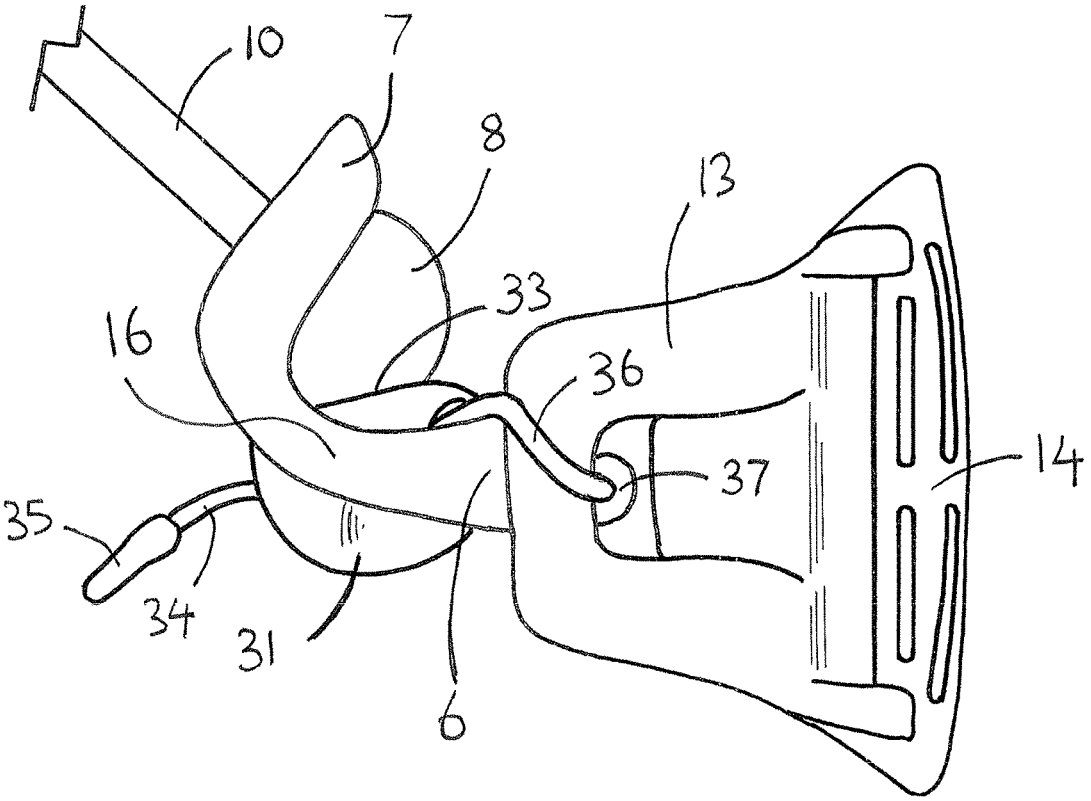
FIG. 17 illustrates a first side view of a third hookless coupling socket and gate.
Figure 18:
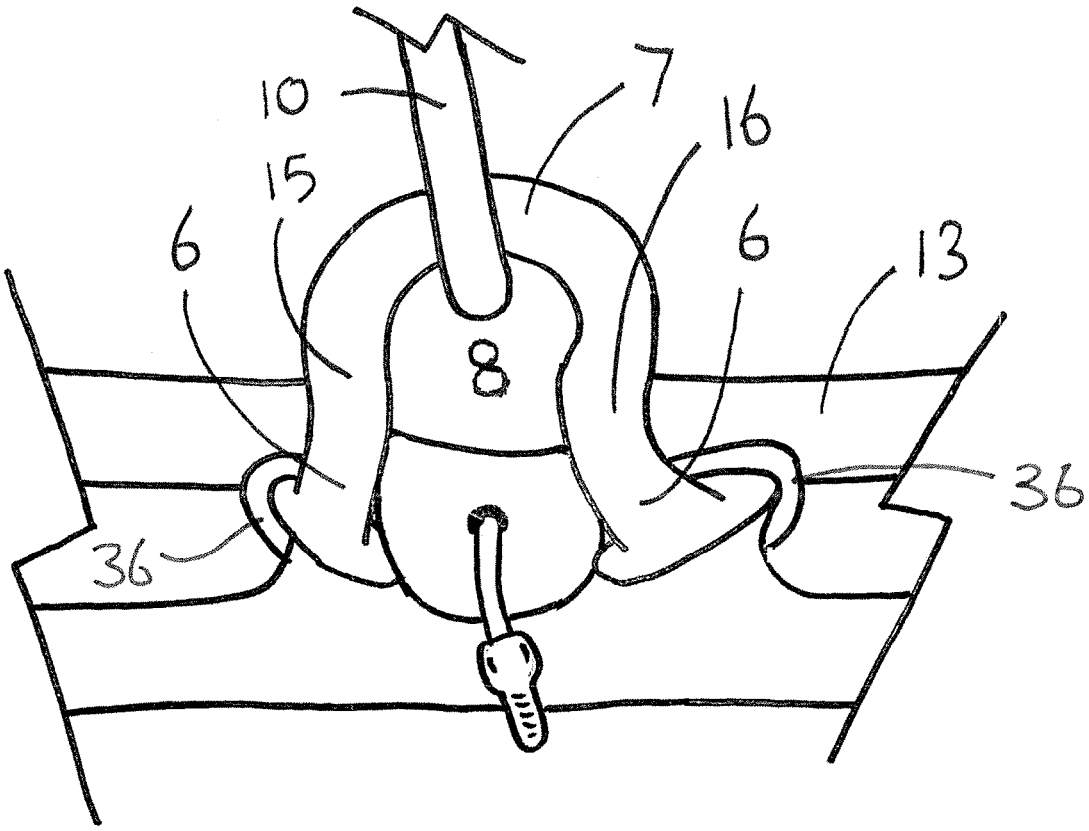
FIG. 18 illustrates a first partial front view of the third hookless coupling socket and gate.
Figure 19:
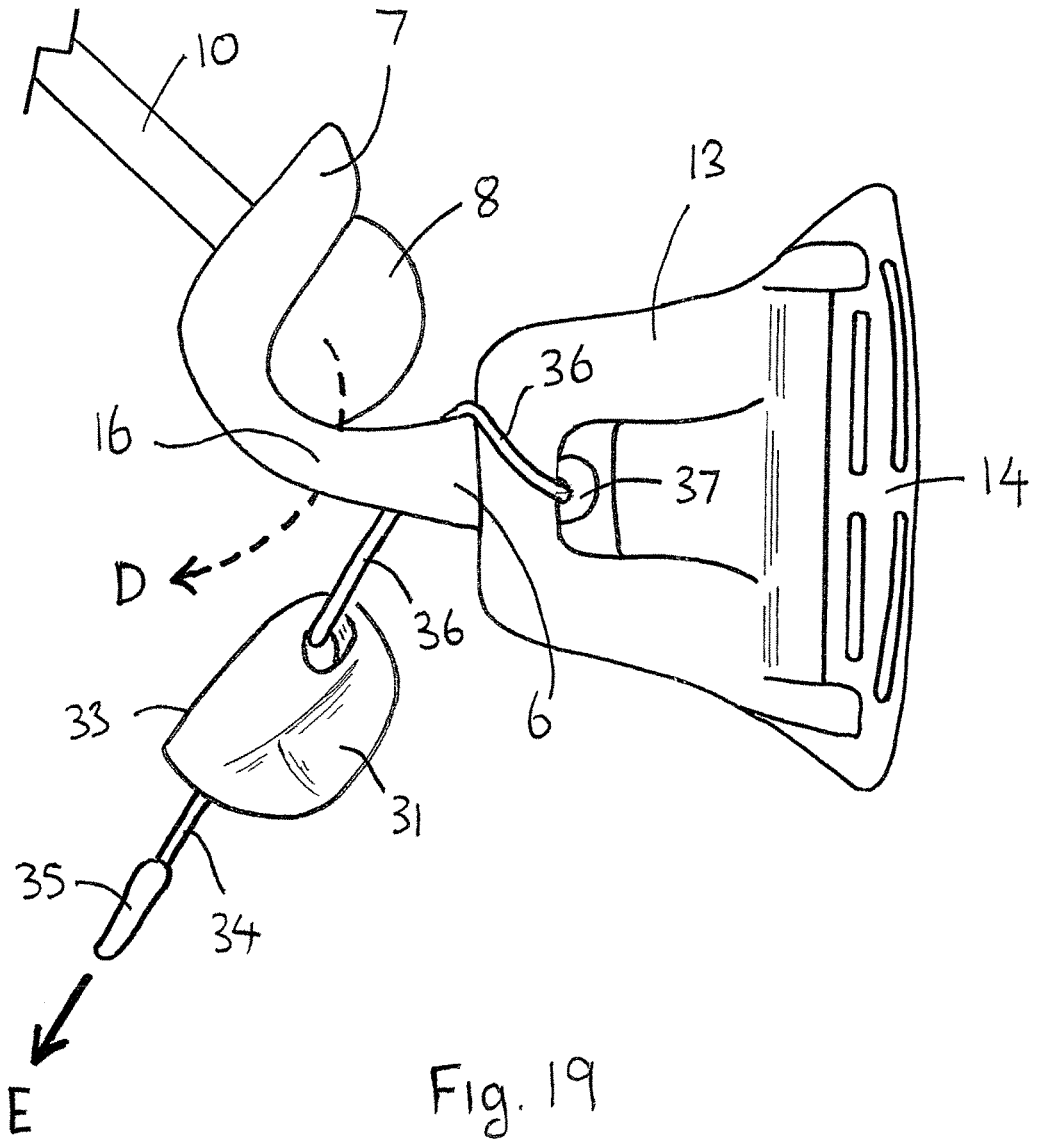
FIG. 19 illustrates a second side view of the third hookless coupling socket and gate.
Figure 20:
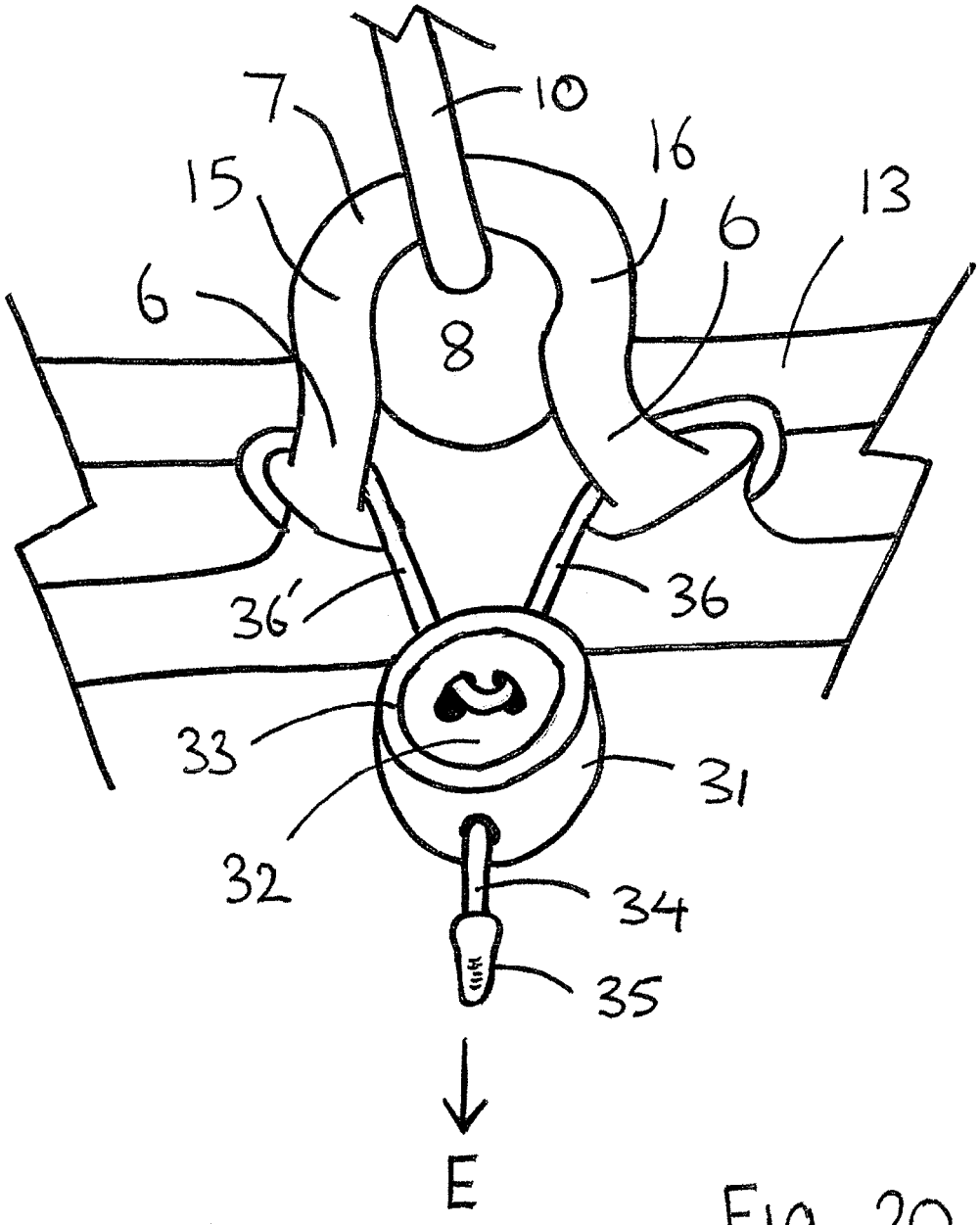
FIG. 20 illustrates a second partial front view of the third hookless coupling socket and gate.

The length of the resiliently elastic cords 36 is such that, when the graspable ferrule 35 is not being pulled downwardly and away from the hookless coupling device 5 by a rider, the resiliently elastic cords 36 bias the hemispherical-shaped cup 31 within the elongate slot 9, 11 so as to interfere with the wider end 11 of the elongate slot 9, 11. The elastic cords 36 remain in partial tension to apply a biasing force to the hemispherical-shaped cup 31. The ball engager 8 is prevented from passing through the wider end 11 of the elongate slot 9, 11. Referring to FIGS. 19 and 20, in order to facilitate engagement and uncoupling of the ball engager 8 and hookless coupling device 5 the rider grasps the graspable ferrule 35 and draws the graspable ferrule 35 downwardly and away from the hookless coupling device 5, for example in the direction of arrow E in FIGS. 19 and 20. This in turn draws the hemispherical-shaped cup 31 downwardly and away from the hookless coupling device 5 clearing the hemispherical-shaped cup 31 from within the wider end 11 of the elongate slot 9, 11. It also further tensions, stretches, the elastic cords 36. The rider may then engage and uncouple the ball engager 8 and hookless coupling device 5 as hereinbefore described. The rider grasps and pulls the graspable ferrule 35 with one hand, while manipulating the ball engager 8 with the other hand. Referring to FIGS. 17 and 18, when the ball engager 8 and hookless coupling device 5 are engaged and the graspable ferrule 35 released to return the elastic cords 36 to the partial tensioned state the hemispherical-shaped cup 31 is biased within the wider end 11 of the elongate slot 9, 11. The interior cavity 32 of the hemispherical-shaped cup 31 surrounds a portion of the ball engager 8. The circular equatorial edge 33 between the outer and inner surfaces 31, 32 bear against the ball engager 8 such that the ball engager 8 is prevented from unintentional uncoupling from the hookless coupling device 5.

Figure 21:
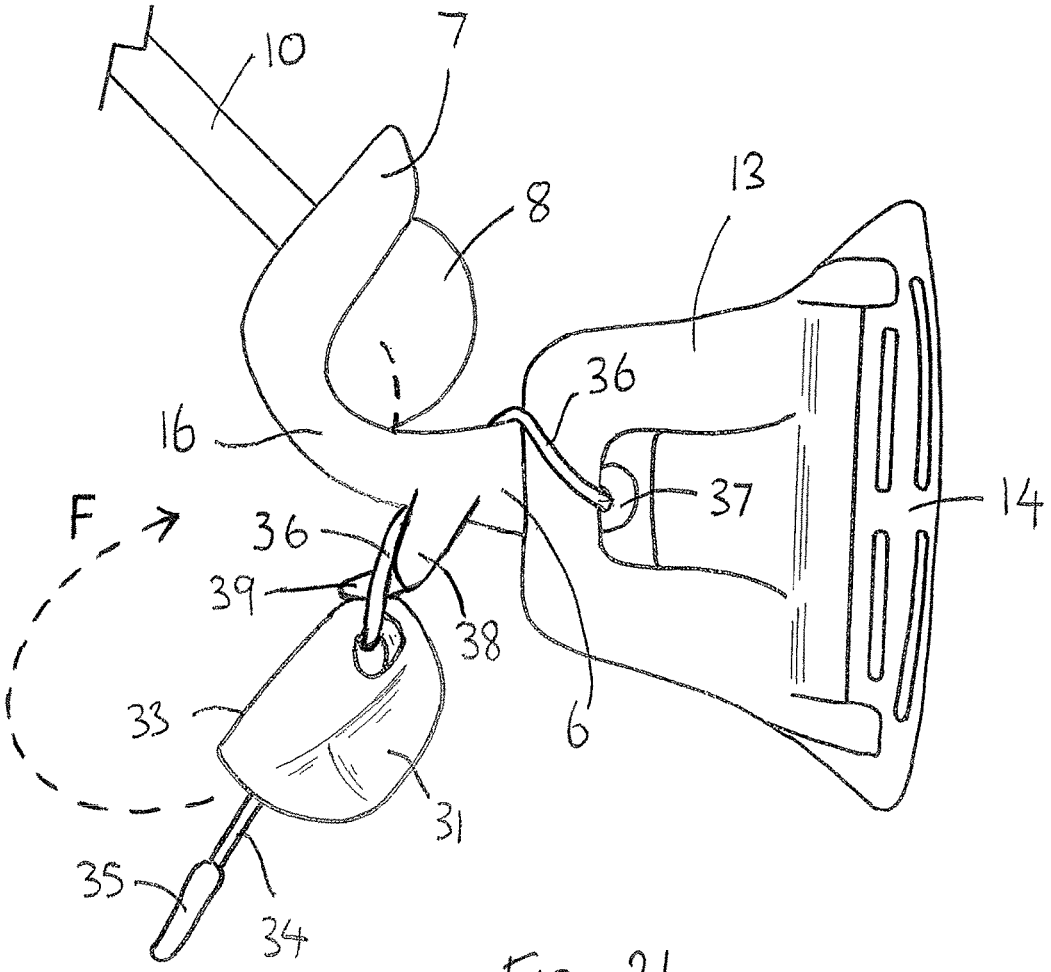
FIG. 21 illustrates a side view of a fourth hookless coupling socket and gate.
Figure 22:
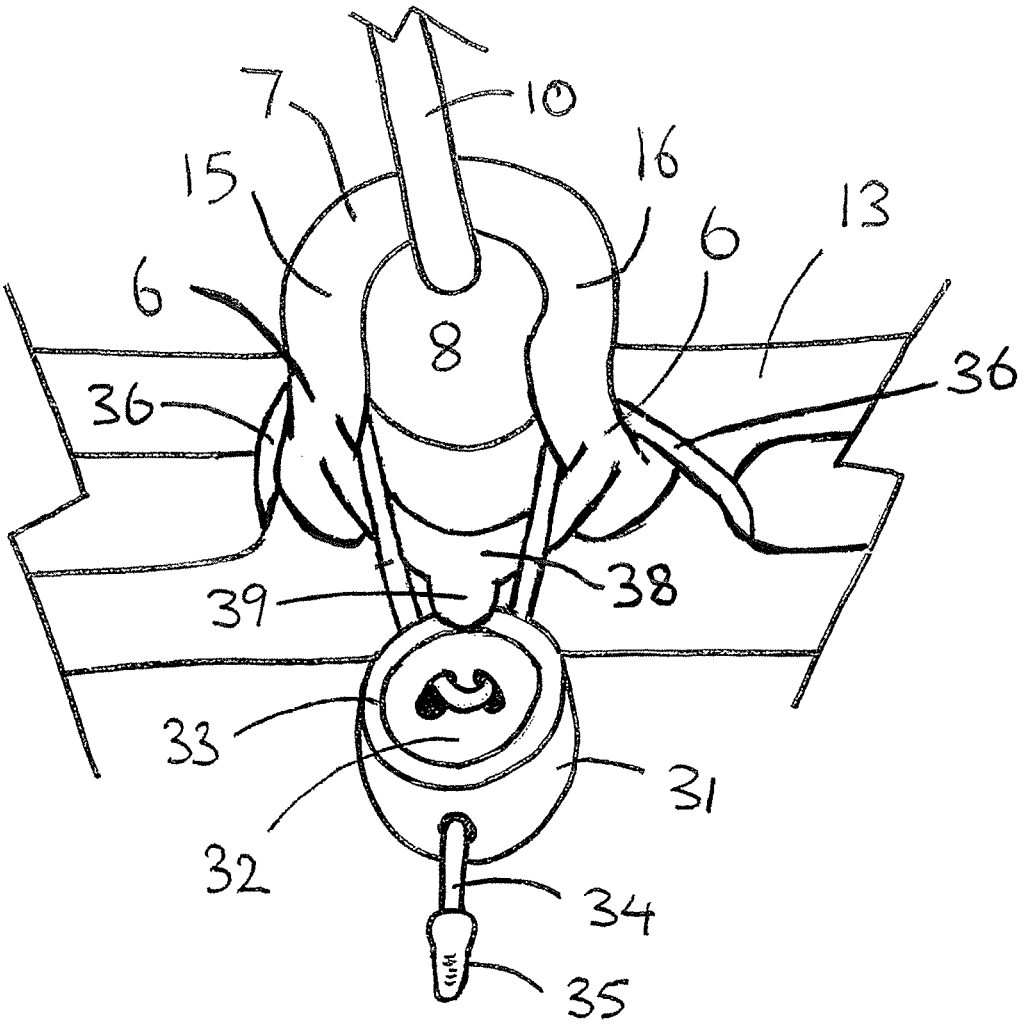
FIG. 22 illustrates a partial front perspective view of the fourth hookless coupling socket and gate.

FIGS. 21 and 22 show a further embodiment of the hookless coupling device of FIGS. 17 through 20, with the addition of a bar 38 and tongue 39 for supporting and maintaining the hemispherical-shaped cup-type gate 31 on the open position. The bar 38 is an elongate bar affix at its two ends adjacent respective connector ends 6 of the hookless coupling device 5. The bar protrudes downwardly preferably in a curvilinear shape such that the centre or mid-portion of the bar 38 is the lower-most part of the bar 38 spaced away from the wider end 11 of the elongate slot 9, 11. A tab or tongue 29 extends from the centre or mid-portion of the bar 38 in a forward direction away from the spreader bar 13. In use, when downwardly and away from the hookless coupling device 5 the circular equatorial edge 33 of the hemispherical-shaped cup-type gate 31 can be engaged under the tongue 39. The further tensioned elastic cords 36 bias the circular equatorial edge 33 against the lower surface of the tongue 39 such that the rider can release the graspable ferrule 35 and the hemispherical-shaped cup-type gate 31 is held spaced apart from the wider end 11 of the elongate slot 9, 11 by the tongue 39 and bias of the elastic cords 36. In this configuration the rider can engage and disengage the ball engager 8 from the hookless coupling device 5 freely without need to hold or manipulate the hemispherical-shaped cup-type gate 31. To reengage the hemispherical-shaped cup-type gate 31 the rider can use the graspable ferrule 35 or push the back-side of the hemispherical-shaped cup 31 to move the cup 31 forward disengaging the circular equatorial edge 33 from under the tongue 39. Tension in the elastic cords 36 will then draw the hemispherical-shaped cup 31 upwardly and inwardly towards the wider end 11 of the elongate slot 9, 11 so that the hemispherical-shaped cup 31 rests in and interferes with the wider end 11 of the elongate slot 9, 11. The direction of movement of the hemispherical-shaped cup 31 is illustrated by broken arrow line F.

Although the preferred embodiment of the invention is a coupling device, the invention may be embodied as or sold coupled to or in conjunction with one or more of the engager, a spreader bar, a sports harness or a sports kite in part or complete. The preferred embodiment of the coupling device is described or illustrated for use in kite surfing. However, the skilled addressee with appreciate that the coupling device will find equal and equivalent application in other sports requiring a rider or user to be selectively coupled to sports equipment via a body harness. Such alternative examples include but are not limited to wind surfing and sailing trapeze.

The invention claimed is:

1. A hookless coupling device for a sports harness, the coupling device comprising:

an elongate body having a connector end for connection with a sports harness, an engagement end, and an elongate aperture extending between the connector end and the engagement end, wherein the elongate aperture is relatively wider at the connector end, for receiving an engager through the elongate aperture, and relatively narrower at the engagement end, for engaging the engager to the elongate body; and a gate having a first position, in which an engager may pass through the elongate aperture at the connector end, and a second position in which the gate interferes with the elongate aperture at the connector end to prevent the engager from passing through the elongate aperture at the connector end, wherein the gate comprises a gate body freely positioned adjacent the elongate aperture at the connector end, and a resiliently elastic tether secured at a first end to the gate body and at a second end to the elongate body, and, in the second position, the resiliently elastic tether biases the gate body adjacent the elongate aperture, at the connector end, and, in the first position, the gate body is separated from the elongate aperture, at the connector end, by extending or stretching the resiliently elastic tether, so that the resiliently elastic tether urges the gate body towards the second position.

2. The hookless coupling device of claim 1 wherein the engagement end comprises a socket for pivotally engaging the engager with the elongate body.

3. The hookless coupling device of claim 1, wherein the connector end includes an orthogonal spreader bar connectable between straps of a sports harness.

4. The hookless coupling device of claim 1, wherein the elongate body extends away from the connector end.

5. The hookless coupling device of claim 1, wherein the elongate body comprises a frame having two sides, defining opposite elongate edges of the elongate aperture, and a curved end joining the two sides at the engagement end.

6. The hookless coupling device of claim 5, wherein the curved end defines a semi-circular socket for pivotally receiving the engager.

7. The hookless coupling device of claim 1 and an engager, wherein the engager comprises a spherical body and an engager aperture for securing a line of a sports device to the engager.

8. The hookless coupling device of claim 7, wherein the engager aperture is an aperture in the spherical body.

9. The hookless coupling device of claim 1, wherein the gate comprises a U-shaped gate having two open ends pivotally connected at respective sides of the aperture, and the U-shaped gate pivots between the first and second positions.

10. The hookless coupling device of claim 9, wherein, in the first position the U-shaped gate is aligned with and adjacent the engagement end of the elongate body, and in the second position, the U-shaped gate extends across the elongate aperture at the connector end to interfere with the elongate aperture at the connector end and prevent, in the second position, an engager from passing through the elongate aperture at the connector end.

11. The hookless coupling device of claim 1, wherein the gate body includes a graspable portion graspable by a user for manually separating the gate body from the elongate aperture at the connector end.

12. The hookless coupling device of claim 1, wherein the gate body is a spherical body having a cavity for selectively surrounding a portion of an engager.

13. The hookless coupling device of claim 1, wherein the gate body comprises a hemispherical-shaped cup having a hemispherical outer surface, a hollow interior cavity defining a hemispherical inner surface, and a circular equatorial edge between the outer and inner surfaces.

14. The hookless coupling device of claim 1 further comprising an elongate bar affixed at respective ends, adjacent respective connector ends of the elongate body, wherein the elongate bar protrudes in a curvilinear shape such that a center of the elongate bar is spaced from the elongate aperture at the connector end, and a tongue extending from the center of the elongate bar in a forward direction, away from the connector ends of the elongate body.

15. The hookless coupling device of claim 1, including a sports harness comprising a band for surrounding a person, wherein the hookless elongate body extends away from the band.

16. The hookless coupling device of claim 15 further including a sports kite comprising a canopy, a traction line having a first end tethered to the canopy and a second end, and a spherical engager connected to the second end of the traction line.

* * * * *